US009981229B2

(12) United States Patent
Matsunaga et al.

(10) Patent No.: US 9,981,229 B2
(45) Date of Patent: May 29, 2018

(54) LOOP FLOW BUBBLE-GENERATING NOZZLE

(71) Applicant: OK Engineering Co. Ltd., Osaka (JP)

(72) Inventors: Takeshi Matsunaga, Osaka (JP); Daisuke Matsunaga, Osaka (JP)

(73) Assignee: OK ENGINEERING CO., LTD., Osaka (JP)

( * ) Notice: Subject to any disclaimer, the term of this patent is extended or adjusted under 35 U.S.C. 154(b) by 56 days.

(21) Appl. No.: 15/302,991

(22) PCT Filed: Jan. 27, 2015

(86) PCT No.: PCT/JP2015/052114
§ 371 (c)(1),
(2) Date: Oct. 9, 2016

(87) PCT Pub. No.: WO2015/156015
PCT Pub. Date: Oct. 15, 2015

(65) Prior Publication Data

US 2017/0028364 A1 Feb. 2, 2017

(30) Foreign Application Priority Data

Apr. 11, 2014 (JP) ..... 2014-082085

(51) Int. Cl.
*B01F 3/04* (2006.01)
*B01F 5/04* (2006.01)
(Continued)

(52) U.S. Cl.
CPC ..... *B01F 3/04503* (2013.01); *B01F 3/0446* (2013.01); *B01F 5/04* (2013.01);
(Continued)

(58) Field of Classification Search
CPC .. B01F 3/04; B01F 3/0446; B01F 5/00; B01F 5/02; B01F 5/04
(Continued)

(56) References Cited

U.S. PATENT DOCUMENTS

2008/0230632 A1 9/2008 Fenton et al.

FOREIGN PATENT DOCUMENTS

| | | | |
|---|---|---|---|
| JP | 2008062151 | A | 3/2008 |
| JP | 2008114098 | A | 5/2008 |
| JP | 2009189984 | A | 8/2009 |

OTHER PUBLICATIONS

European Patent Office Search Report, dated Nov. 22, 2017.

*Primary Examiner* — Robert A Hopkins
(74) *Attorney, Agent, or Firm* — PatShegen IP

(57) ABSTRACT

There is provided a loop flow type bubble generation nozzle capable of improving the bubble generation efficiency compared to conventional nozzles without reducing the bubble generation efficiency even when liquid containing impurities is used. A loop flow type bubble generation nozzle 10 includes a tubular bottomed member 1 having a circular cross section and a tubular member 2 which is fitted into the other end side of the bottomed member 1. A substantially cylindrical space surrounded by the bottomed member 1 and the tubular member 2 serves as a loop flow type gas-liquid stirring and mixing chamber 6. The tubular member 2 has, on the center thereof, an inflow hole 7 which is capable of allowing liquid and gas to flow therein, and a first jet hole 8*a* and a second jet hole 8*b* which are capable of jetting liquid and gas. The inflow hole 7 is formed in a tapered shape whose diameter continuously expands from the first jet hole 8*a* toward the loop flow type gas-liquid stirring and mixing chamber 6. A plurality of cut-away parts 7*a* are formed on an end face of the inflow hole 7, the end face
(Continued)

facing the loop flow type gas-liquid stirring and mixing chamber 6.

4 Claims, 6 Drawing Sheets

(51) Int. Cl.
*B05B 7/04* (2006.01)
*B05B 1/18* (2006.01)

(52) U.S. Cl.
CPC ..... *B01F 5/043* (2013.01); *B05B 7/0425* (2013.01); *B01F 2005/0438* (2013.01); *B05B 1/18* (2013.01); *B05B 7/0458* (2013.01); *B05B 7/0483* (2013.01)

(58) Field of Classification Search
USPC ..... 261/76
See application file for complete search history.

LOOP FLOW BUBBLE-GENERATING NOZZLE

TECHNICAL FIELD

The present invention relates to a loop flow type bubble generation nozzle which generates bubbles (air bubbles) including fine bubbles (nanobubbles and microbubbles).

BACKGROUND ART

Conventionally, the inventor of the present application has invented a nozzle capable of generating bubbles as disclosed in Patent Literature 1. The nozzle is a loop flow type bubble generation nozzle which includes a loop flow type gas-liquid stirring and mixing chamber which stirs and mixes liquid and gas by a loop-like flow to form a fluid mixture, a liquid feed hole which is formed on one end of the loop flow type gas-liquid stirring and mixing chamber and feeds pressurized liquid to the loop flow type gas-liquid stirring and mixing chamber, at least one gas inflow hole into which gas flows, a gas feed chamber which is formed on the other end side of the loop flow type gas-liquid stirring and mixing chamber and feeds gas flowing in through the at least one gas inflow hole to the loop flow type gas-liquid stirring and mixing chamber toward one end side of the loop flow type gas-liquid stirring and mixing chamber through the entire circumference or part of the circumference while circulating the gas around a central axis of the liquid feed hole, and a jet hole which is formed on the other end of the loop flow type gas-liquid stirring and mixing chamber in a manner to align a central axis of the jet hole with the central axis of the liquid feed hole, has a diameter larger than the diameter of the liquid feed hole, and jets the fluid mixture from the loop flow type gas-liquid stirring and mixing chamber.

CITATION LIST

Patent Literature

Patent Document 1: Japanese Patent Laid-open Publication No. 2009-189984

SUMMARY OF THE INVENTION

Technical Problems

However, when liquid (sludge water, sea water, etc.) containing relatively large number of impurities such as calcium and microorganisms (including plankton of shellfishes, the same applies hereinbelow) is used to generate bubbles in the bubble generation nozzle described in Patent Literature 1, sludge (a solid body) or/and scale (so-called fur) formed from impurities such as calcium and dead microorganisms may be deposited and adhered between the loop flow type gas-liquid stirring and mixing chamber and the gas feed chamber of the nozzle by a splash phenomenon (a phenomenon of liquid splashing) caused by cavitation (a physical phenomenon in which generation and disappearance of bubbles occur in a short time due to a difference in pressure in the flow of liquid). In this case, gas feed from the gas feed chamber to the loop flow type gas-liquid stirring and mixing chamber may be obstructed to reduce the gas feed amount. This may gradually reduce the bubble generation efficiency. Further, in bubble generation nozzles represented by Patent Literature 1, further improvement in bubble generation efficiency is demanded.

Therefore, an object of the present invention is to provide a loop flow type bubble generation nozzle capable of improving the bubble generation efficiency compared to conventional nozzles without reducing the bubble generation efficiency even when liquid containing impurities is used.

Solutions to Problems (1) A loop flow type bubble generation nozzle of the present invention includes: a loop flow type gas-liquid stirring and mixing chamber that stirs and mixes liquid and gas by a loop-like flow to forma fluid mixture; a liquid feed hole formed on one end of the loop flow type gas-liquid stirring and mixing chamber, the liquid feed hole feeding pressurized liquid to the loop flow type gas-liquid stirring and mixing chamber; at least one gas inflow hole into which gas flows; a gas feed chamber formed on the other end side of the loop flow type gas-liquid stirring and mixing chamber, the gas feed chamber feeding gas flowing in through the at least one gas inflow hole to the loop flow type gas-liquid stirring and mixing chamber toward one end side of the loop flow type gas-liquid stirring and mixing chamber through the entire circumference or part of the circumference while circulating the gas around a central axis of the liquid feed hole; a jet hole formed on the other end of the loop flow type gas-liquid stirring and mixing chamber in a manner to align a central axis of the jet hole with the central axis of the liquid feed hole, the jet hole having a diameter larger than the diameter of the liquid feed hole and jetting the fluid mixture from the loop flow type gas-liquid stirring and mixing chamber; and a tapered section whose diameter continuously expands from the jet hole toward the loop flow type gas-liquid stirring and mixing chamber, wherein at least one cut-away part is formed on an end of the tapered section, the end facing the loop flow type gas-liquid stirring and mixing chamber.

In the configuration of the above (1), liquid is fed to the loop flow type gas-liquid stirring and mixing chamber through the liquid feed hole and gas is fed to the loop flow type gas-liquid stirring and mixing chamber through the gas feed chamber. Accordingly, when the fluid mixture inside the loop flow type gas-liquid stirring and mixing chamber is jetted through the jet hole, a loop-like flow (also referred to as "loop flow") of liquid containing gas is generated inside the loop flow type gas-liquid stirring and mixing chamber.

The loop flow indicates a series of flow that flows along the flow of liquid flowing from the liquid feed hole to the jet hole, then reverses near the jet hole by outside gas or/and outside liquid flowing in through the jet hole and flows along the inner wall of the loop flow type gas-liquid stirring and mixing chamber, and then again flows along the flow of liquid fed through the liquid feed hole. The speed of a loop flow to be generated can be controlled to some extent from a low speed to a high speed by the feed amount and pressure of liquid and gas. Thus, it is also possible to form a high speed loop flow by adjusting the feed amount and pressure of liquid and gas to further increase the speed of the loop flow.

When the fluid mixture inside the loop flow type gas-liquid stirring and mixing chamber is jetted through the jet hole, the inside of the loop flow type gas-liquid stirring and mixing chamber is brought into a negative pressure. Thus, gas flows in from the gas inflow hole through the gas feed chamber. In addition, since the diameter of the jet hole is larger than the diameter of the liquid feed hole, outside gas or/and outside liquid flows into the loop flow type gas-liquid stirring and mixing chamber through a gap between the inner wall of the jet hole and the periphery of the fluid mixture in the jet hole (outside gas or/and outside liquid flows in due to the external environment).

(a) Gas fed to the loop flow type gas-liquid stirring and mixing chamber through the gas feed chamber is broken up by a turbulent flow generated on the boundary between the gas feed chamber and the loop flow type gas-liquid stirring and mixing chamber; (b) stirred and sheared by a loop flow; and (c) further broken up by a turbulent flow generated when part of the gas collides with liquid fed through the liquid feed hole, and jetted through the jet hole. Further, (d) the gas in the loop flow is further broken up by outside gas or outside liquid flowing into the loop flow type gas-liquid stirring and mixing chamber through the jet hole. A mechanism of the generation of air bubbles micronized in these steps (a) to (d) is a feature of the loop flow type bubble generation nozzle and a superior point which is not provided in other nozzles.

Further, (e) gas flowing in through the gas inflow hole is fed into the loop flow type gas-liquid stirring and mixing chamber toward one end side of the loop flow type gas-liquid stirring and mixing chamber through the entire circumference or part of the circumference while being circulated around the central axis of the liquid feed hole in the gas feed chamber. This step (e) improves the degree of vacuum inside the loop flow type gas-liquid stirring and mixing chamber. Thus, it is possible to further increase the amount of gas flowing in through the gas inflow hole to accelerate the generation of air bubbles.

Thus, bubbles having an average diameter of less than 100 μm, in particular, fine bubbles including microbubbles and nanobubbles having an average diameter of approximately 20 μm can be generated with a simpler configuration than conventional products. Further, since the configuration is simpler than that in conventional products, downsizing to a smaller size than conventional products can be achieved.

Further, in the configuration of the above (1), gas can be stirred and sheared so as to be further broken up by a turbulence flow generated by the high speed loop flow by the cut-away part of the inflow hole (the end of the tapered section facing the loop flow type gas-liquid stirring and mixing chamber). Further, (a) splash liquid which may get into the gas feed chamber from the loop flow type gas-liquid stirring and mixing chamber by a splash phenomenon caused by cavitation occurring in a gas-liquid boundary which is the boundary between the gas feed chamber and the loop flow type gas-liquid stirring and mixing chamber or/and (b) fine bubbles near the gas-liquid boundary may be dried, concentrated, or aggregated near the gas-liquid boundary to cause scale or/and sludge of, for example, calcium to deposit and adhere onto the wall of the gas feed chamber. Even in such a case, since the cut-away part of the inflow hole remains as a space, for example, a continuous ring-like scale or/and sludge is not formed. Further, the cut-away part of the inflow hole has a sufficient space. Thus, even when splash liquid getting into the gas feed chamber around the cut-away part forms scale or/and sludge, at least scale or/and sludge deposited and adhered onto the side part of the cut-away part can be destroyed by a shock wave generated by the self-collapse of cavitation and a shock wave generated by the collapse of fine bubbles colliding with another matter. Therefore, since the gas feed chamber is not blocked (calcium or the like is not deposited and adhered at least onto the space part and the side part of the cut-away part), it is possible to prevent gas feed from the gas feed chamber from being obstructed. As a result, in the loop flow type bubble generation nozzle of the above (1), the bubble generation efficiency is not reduced even when liquid containing impurities is used. Accordingly, since gas flowing in through the gas inflow hole is stably fed to the loop flow type gas-liquid stirring and mixing chamber, the high speed loop flow inside the loop flow type gas-liquid stirring and mixing chamber can be stabilized.

(2) In the loop flow type bubble generation nozzle according to the above (1), a cut-away part is preferably further formed to extend from the at least one cut-away part toward the gas feed chamber.

In the configuration of the above (2), since calcium or the like is not deposited and adhered onto the space part of the cut-away part, it is possible to reliably prevent gas feed from the gas feed chamber from being obstructed. As a result, in the loop flow type bubble generation nozzle according to the present invention, a reduction in the bubble generation efficiency is reliably prevented even when liquid containing impurities is used. Accordingly, since gas flowing in through the gas inflow hole is stably fed to the loop flow type gas-liquid stirring and mixing chamber, the high speed loop flow inside the loop flow type gas-liquid stirring and mixing chamber can be stabilized.

(3) As another aspect, a loop flow type bubble generation nozzle according to the present invention includes: a loop flow type gas-liquid stirring and mixing chamber stirring and mixing liquid and gas by a loop-like flow to form a fluid mixture; a liquid feed hole formed on one end of the loop flow type gas-liquid stirring and mixing chamber, the liquid feed hole feeding pressurized liquid to the loop flow type gas-liquid stirring and mixing chamber; at least one gas inflow hole into which gas flows; a gas feed chamber formed on the other end side of the loop flow type gas-liquid stirring and mixing chamber, the gas feed chamber feeding gas flowing in through the at least one gas inflow hole to the loop flow type gas-liquid stirring and mixing chamber toward one end side of the loop flow type gas-liquid stirring and mixing chamber through the entire circumference or part of the circumference while circulating the gas around a central axis of the liquid feed hole; a jet hole formed on the other end of the loop flow type gas-liquid stirring and mixing chamber in a manner to align a central axis of the jet hole with the central axis of the liquid feed hole, the jet hole having a diameter larger than the diameter of the liquid feed hole and jetting the fluid mixture from the loop flow type gas-liquid stirring and mixing chamber; and a recessed gas reservoir section formed on the gas feed chamber at a side facing the loop flow type gas-liquid stirring and mixing chamber on the entire circumference or part of the circumference of the gas feed chamber.

In the configuration of the above (3), as with the loop flow type bubble generation nozzle of the above (1), bubbles having an average diameter of less than 100 μm, in particular, fine bubbles including microbubbles and nanobubbles having an average diameter of approximately 20 μm can be generated with a simpler configuration than conventional products. Further, since the configuration is simpler than that in conventional products, downsizing to a smaller size than conventional products can be achieved.

Further, the gas reservoir section enables the amount of gas flowing in through the gas inflow hole to be further increased to accelerate the generation of air bubbles. Further, (a) splash liquid which may get into the gas feed chamber by a splash phenomenon caused by cavitation occurring in a gas-liquid boundary which is the boundary between the gas feed chamber and the loop flow type gas-liquid stirring and mixing chamber or/and (b) fine bubbles near the gas-liquid boundary may be dried, concentrated, or aggregated near the gas-liquid boundary to cause scale or/and sludge of, for example, calcium to deposit and adhere in a ring-like form onto the wall of the gas feed chamber (for example, a position several mm away from the loop flow type gas-liquid stirring and mixing chamber in the gas feed chamber). Even in such a case, since a sufficient space is ensured by the gas reservoir section, the gas feed chamber is not blocked. As a result, in the loop flow type bubble generation nozzle of the above (3), the bubble generation efficiency is not reduced even when liquid containing impurities is used. Accordingly, since gas flowing in through the gas inflow hole is stably fed to the loop flow type gas-liquid stirring and mixing chamber, the high speed loop flow inside the loop flow type gas-liquid stirring and mixing chamber can be stabilized.

(4) In the loop flow type bubble generation nozzle according to the above (4), a recessed stirring and mixing section further stirring and mixing the fluid mixture inside the loop flow type gas-liquid stirring and mixing chamber may be formed on an inner wall of the loop flow type gas-liquid stirring and mixing chamber.

In the configuration of the above (4), a further loop flow can be formed. This enables the fluid mixture inside the loop flow type gas-liquid stirring and mixing chamber to be further stirred and mixed. Accordingly, it is possible to further efficiently generate fine bubbles.

(5) As another aspect, a loop flow type bubble generation nozzle according to the present invention includes: a loop flow type gas-liquid stirring and mixing chamber stirring and mixing liquid and gas by a loop-like flow to form a fluid mixture; a liquid feed hole formed on one end of the loop flow type gas-liquid stirring and mixing chamber, the liquid feed hole feeding pressurized liquid to the loop flow type gas-liquid stirring and mixing chamber; at least one gas inflow hole into which gas flows; a gas feed chamber formed on the other end side of the loop flow type gas-liquid stirring and mixing chamber, the gas feed chamber feeding gas flowing in through the at least one gas inflow hole to the loop flow type gas-liquid stirring and mixing chamber toward one end side of the loop flow type gas-liquid stirring and mixing chamber through the entire circumference or part of the circumference while circulating the gas around a central axis of the liquid feed hole; a jet hole formed on the other end of the loop flow type gas-liquid stirring and mixing chamber in a manner to align a central axis of the jet hole with the central axis of the liquid feed hole, the jet hole having a diameter larger than the diameter of the liquid feed hole and jetting the fluid mixture from the loop flow type gas-liquid stirring and mixing chamber; and a recessed stirring and mixing section formed on an inner wall of the loop flow type gas-liquid stirring and mixing chamber, the recessed stirring and mixing section further stirring and mixing the fluid mixture inside the loop flow type gas-liquid stirring and mixing chamber.

In the configuration of the above (5), as with the loop flow type bubble generation nozzle of the above (1), bubbles having an average diameter of less than 100 μm, in particular, fine bubbles including microbubbles and nanobubbles having an average diameter of approximately 20 μm can be generated with a simpler configuration than conventional products. Further, since the configuration is simpler than that in conventional products, downsizing to a smaller size than conventional products can be achieved.

DESCRIPTION OF EMBODIMENTS

First Embodiment

Figure 1:
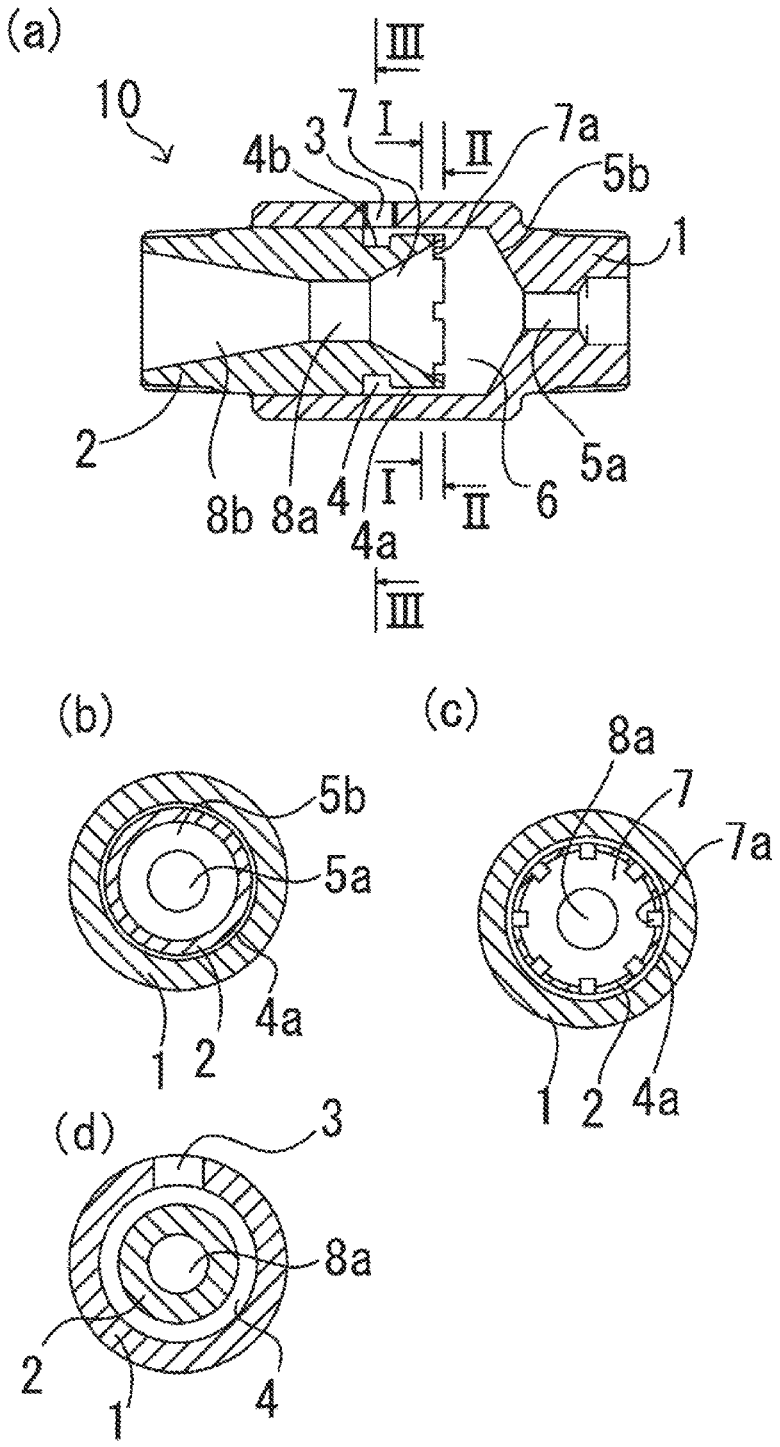
FIG. 1(*a*) is a schematic sectional view showing a bubble generation nozzle according to a first embodiment, FIG. 1(*b*) is a sectional view on arrows I-I in FIG. 1(*a*), FIG. 1(*c*) is a sectional view on arrows II-II in FIG. 1(*a*), and FIG. 1(*d*) is a sectional view on arrows III-III in FIG. 1(*a*).
Figure 2:
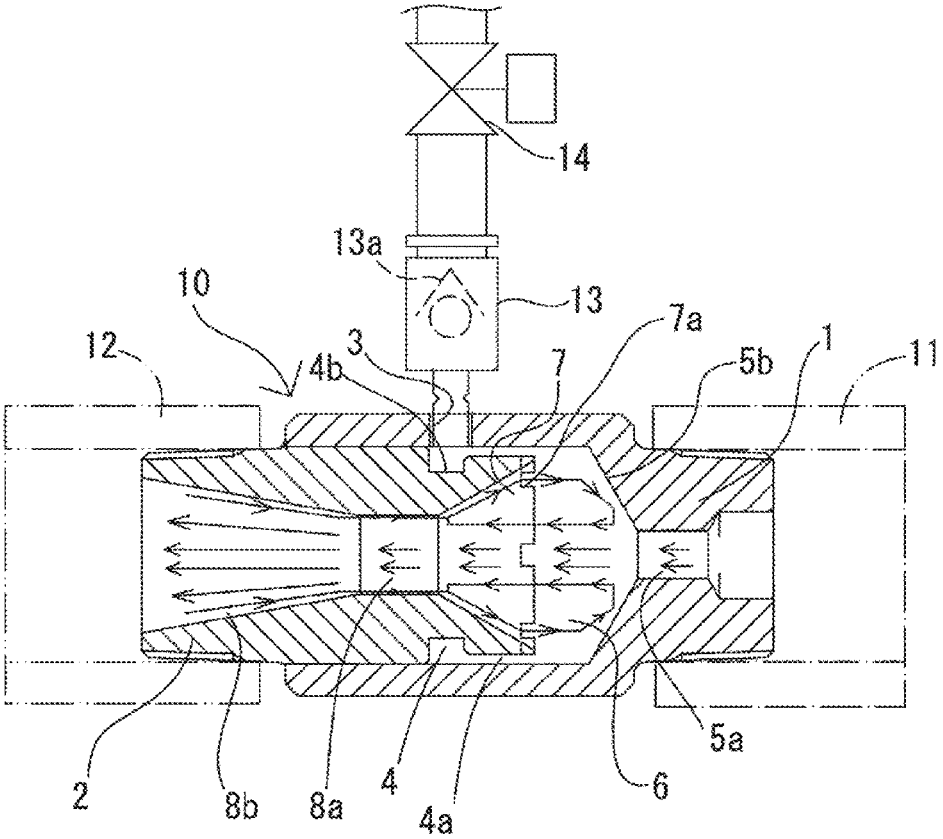
FIG. 2 is a diagram for describing the operation of the loop flow type bubble generation nozzle in FIGS. 1(*a*) to 1(*d*).

A first embodiment of the present invention will be described below with reference to FIGS. 1(*a*) to 1(*d*), and 2. FIG. 1(*a*) is a schematic sectional view showing a loop flow type bubble generation nozzle 10 according to the first embodiment, FIG. 1(*b*) is a sectional view on arrows I-I in FIG. 1(*a*), FIG. 1(*c*) is a sectional view on arrows II-II in FIG. 1(*a*), and FIG. 1(*d*) is a sectional view on arrows III-III in FIG. 1(*a*). FIG. 2 is a diagram for describing the operation of the loop flow type bubble generation nozzle 10.

Configuration of Loop Flow Type Bubble Generation Nozzle 10

As shown in FIG. 1(*a*), the loop flow type bubble generation nozzle 10 includes a bottomed member 1 as a bottomed tubular first member having a circular cross section and a tubular member 2 as a second member which is fitted into the other end side of the bottomed member 1. A substantially cylindrical space surrounded by the bottomed member 1 and the tubular member 2 serves as a loop flow type gas-liquid stirring and mixing chamber 6.

The bottomed member 1 has, on the side part thereof, a gas inflow hole 3 which allows the outside and the inside of the loop flow type bubble generation nozzle 10 to communicate with each other to let gas flow therein. Further, two or more gas inflow holes 3 may be formed. The bottomed member 1 has, on the center of the bottom part thereof, a first liquid feed hole 5*a* and a second liquid feed hole 5*b* to which liquid that has been pressurized (liquid to which pressure is applied even slightly, hereinbelow, may also be referred to as "pressurized liquid") is fed from the outside. The pressurized liquid fed from the outside is fed to the loop flow type gas-liquid stirring and mixing chamber 6 through the first liquid feed hole 5*a* and the second liquid feed hole 5*b* in this order. The central axis of the first liquid feed hole 5*a* and the central axis of the second liquid feed hole 5*b* intersect with the central axis of the gas inflow hole 3.

The second liquid feed hole 5*b* is formed in a tapered shape whose diameter continuously expands from the first liquid feed hole 5*a* toward the loop flow type gas-liquid stirring and mixing chamber 6. The second liquid feed hole 5*b* plays a role of allowing a high speed loop flow to join a flow of the pressurized liquid from a direction opposite to the flow of the pressurized liquid to generate a violent turbulent flow inside the loop flow type gas-liquid stirring and mixing chamber 6.

The tubular member 2 has, on the center thereof, an inflow hole 7 which is capable of allowing liquid and gas to flow therein, and a first jet hole 8*a* and a second jet hole 8*b* which are capable of jetting liquid and gas. The central axes of the inflow hole 7, the first jet hole 8*a*, and the second jet hole 8*b* are aligned with the central axes of the first liquid feed hole 5*a* and the second liquid feed hole 5*b*.

The inflow hole 7 is formed in a tapered shape whose diameter continuously expands from the first jet hole 8*a* toward the loop flow type gas-liquid stirring and mixing chamber 6. A plurality of cut-away parts 7*a* are formed on an end face of the inflow hole 7, the end face facing the loop flow type gas-liquid stirring and mixing chamber 6. The inflow hole 7 plays a role of accelerating a high speed loop flow inside the loop flow type gas-liquid stirring and mixing chamber 6. One end of the first jet hole 8*a* is connected to one end of the inflow hole 7. The other end of the first jet hole 8*a* is connected to one end of the second jet hole 8*b*. The second jet hole 8*b* is formed in a tapered shape whose diameter continuously expands from the first jet hole 8*a* toward a direction opposite to the loop flow type gas-liquid stirring and mixing chamber 6. The second jet hole 8*b* plays a role of adjusting the amount of outside gas and/or outside liquid flowing into the loop flow type gas-liquid stirring and mixing chamber 6 from the first jet hole 8*a* and stabilizing a flow around the outer side of the first jet hole 8*a* (jetting of a fluid mixture from the first jet hole 8*a* and inflow of outside gas or/and outside liquid).

The tubular member 2 has a groove 4*b* which is located on an outer peripheral position facing the gas inflow hole 3 and continuous in the circumferential direction. A ring-like space surrounded by the groove 4*b* and the inner wall surface of the bottomed member 1 serves as a gas feed chamber 4. The gas feed chamber 4 communicates with the loop flow type gas-liquid stirring and mixing chamber 6 through a clearance 4*a*.

As shown in FIG. 1(*d*), the gas inflow hole 3 and the gas feed chamber 4 communicate with each other through the clearance 4*a*. Gas flowing in through the gas inflow hole 3 passes through the clearance 4*a* through the entire circumference or part of the circumference while being circulated around the central axis of the first liquid feed hole 5*a* in the gas feed chamber 4 to be fed to the loop flow type gas-liquid stirring and mixing chamber 6 toward one end side of the loop flow type gas-liquid stirring and mixing chamber 6. Accordingly, a film of gas, air bubbles or/and microbubbles are generated on the inner wall of the loop flow type gas-liquid stirring and mixing chamber 6, and the high speed loop flow is accelerated.

For example, metals such as SUS304 and SUS316, resin, wood, glass, ceramic, and ceramics can be used as the bottomed member 1 and the tubular member 2. Any solid materials may be used. An appropriate material may be selected for each of the components. When resin, glass, or ceramic is selected, the life of the valve generation nozzle 10 can be extended due to its resistance to corrosion.

The loop flow type gas-liquid stirring and mixing chamber 6 is a space in which liquid fed from the second liquid feed hole 5*b* and gas fed from the gas feed chamber 4 are stirred and mixed by a loop-like flow. The second liquid feed hole 5*b* is formed on one end of the loop flow type gas-liquid stirring and mixing chamber 6. The inflow hole 7 is formed on the other end of the loop flow type gas-liquid stirring and mixing chamber 6. The gas feed chamber 4 and the gas inflow hole 3 are formed on the other end side of the loop flow type gas-liquid stirring and mixing chamber 6. Asperities (for example, a so-called rough skin, one similar to a thermal spraying skin of ceramic, or/and simple projections) are formed on the inner wall of the loop flow type gas-liquid stirring and mixing chamber 6. The asperities are not necessarily formed on the entire inner wall, and may be formed only on part of the inner wall. The asperities on the inner wall play a roll of accelerating the high speed loop flow to increase the degree of vacuum inside the loop flow type gas-liquid stirring and mixing chamber 6.

Operation of Loop Flow Type Bubble Generation Nozzle 10

Next, the operation of the loop flow type bubble generation nozzle 10 will be described with reference to FIG. 2. FIG. 2 is a diagram showing the loop flow type bubble generation nozzle 10 of FIGS. 1(*a*) to 1(*d*), a hose 11 which is connected to one end side of the bottomed member 1 of the loop flow type bubble generation nozzle 10, a shower head 12 which is connected to the other end side of the tubular member 2 of the loop flow type bubble generation nozzle 10, a gas feed tube 13 which is connected to the gas inflow hole 3 of the bottomed member 1 of the loop flow type bubble generation nozzle 10, and a throttle valve 14 which adjusts the amount of outside gas flowing into the gas feed tube 13. For the sake of convenience, only the loop flow type bubble generation nozzle 10 is illustrated as a schematic sectional view. One end of the gas feed tube 13 is capable of taking in the outside air. A check valve 13*a* is disposed inside the gas feed tube 13 so as to stably generate bubbles.

First, pressurized liquid is fed from the hose 11 to the loop flow type gas-liquid stirring and mixing chamber 6 through the first liquid feed hole 5*a* and the second liquid feed hole 5*b*. At this point, the pressurized liquid flows along a line connecting the first liquid feed hole 5*a*, the second liquid feed hole 5*b*, the inflow hole 7 and the first jet hole 8*a* of FIG. 2. Then, the pressurized liquid is mostly jetted through the first jet hole 8*a* while being spread, and partially forms a high speed loop flow (a substantially elliptical part inside the loop flow type gas-liquid stirring and mixing chamber 6 in FIG. 2) by outside gas and/or outside liquid flowing in through the second jet hole 8*b* and the first jet hole 8*a*. At this point, part of the pressurized liquid further increases the speed of the high speed loop flow.

Since the inside of the loop flow type gas-liquid stirring and mixing chamber 6 has a negative pressure, gas flows from the gas feed tube 13 into the loop flow type gas-liquid stirring and mixing chamber 6 through the gas feed chamber 4.

Gas fed into the loop flow type gas-liquid stirring and mixing chamber 6 through the gas feed chamber 4 is (a) broken up by a turbulent flow generated on the boundary between the gas feed chamber 4 and the loop flow type gas-liquid stirring and mixing chamber 6; (b) stirred and sheared by a high speed loop flow accelerated by the inflow hole 7 and the second liquid feed hole 5*b*; (c) collides with the asperities on the inner wall of the loop flow type gas-liquid stirring and mixing chamber 6; (d) further broken up by a turbulent flow generated when part of the gas collides with pressurized liquid fed through the first liquid feed hole 5*a* on the way; and (e) collides with outside gas and/or outside liquid flowing into the first jet hole 8*a* to be further broken up, and jetted as a fluid mixture containing bubbles or/and fine bubbles such as microbubbles through the second jet hole 8*b*.

Further, (f) gas flowing in through the gas inflow hole 3 is fed into the loop flow type gas-liquid stirring and mixing chamber 6 toward one end side of the loop flow type gas-liquid stirring and mixing chamber 6 through the entire circumference or part of the circumference while being circulated around the central axis of the first liquid feed hole 5*a* in the gas feed chamber 4. This improves the degree of vacuum inside the loop flow type gas-liquid stirring and mixing chamber 6. Thus, it is possible to further increase the amount of gas flowing in through the gas inflow hole 3 to accelerate the generation of air bubbles.

Bubbles or/and fine bubbles such as microbubbles are continuously generated one after another by such a series of operation.

Since the inflow hole 7 formed in a tapered shape accelerates the high speed loop flow and the second liquid feed hole 5*b* generates a violent turbulent flow, gas inside the loop flow type gas-liquid stirring and mixing chamber 6 can be further broken up.

Further, gas in the high speed loop flow can be stirred and sheared so as to be further broken up by the cut-away parts 7*a* of the inflow hole 7. Further, (a) splash liquid which may get into the clearance 4*a* by a splash phenomenon caused by cavitation occurring in a gas-liquid boundary which is the boundary between the gas feed chamber 4 and the loop flow type gas-liquid stirring and mixing chamber 6 or/and (b) fine bubbles near the gas-liquid boundary may be dried, concentrated, or aggregated near the gas-liquid boundary to cause scale or/and sludge of, for example, calcium to deposit and adhere in a ring-like form onto the outer surface of the tubular member 2 or/and the inner surface of the bottomed member 1 inside the clearance 4*a*. Even in such a case, since the cut-away parts 7*a* of the inflow hole 7 remain as spaces, for example, a continuous ring-like scale or/and sludge is not formed. Further, each of the cut-away parts 7*a* has a sufficient space. Thus, even when splash liquid getting into the gas feed chamber 4 around each of the cut-away parts 7*a* forms scale or/and sludge, at least scale or/and sludge deposited and adhered onto the side part of each of the cut-away parts 7*a* can be destroyed by a shock wave generated by the self-collapse of cavitation and a shock wave generated by the collapse of fine bubbles colliding with another matter. Therefore, since the gas feed chamber 4 is not blocked (calcium or the like is not deposited and adhered at least onto the space part and the side part of each of the cut-away parts 7*a*), it is possible to prevent gas feed from the gas feed chamber 4 from being obstructed. As a result, in the loop flow type bubble generation nozzle 10 according to the present embodiment, the bubble generation efficiency is not reduced even when liquid containing impurities is used. Accordingly, since gas flowing in through the gas inflow hole 3 is stably fed to the loop flow type gas-liquid stirring and mixing chamber 6, the high speed loop flow inside the loop flow type gas-liquid stirring and mixing chamber 6 can be stabilized.

Further, the second jet hole 8*b* formed in a tapered shape adjusts the amount of outside gas and/or outside liquid flowing into the loop flow type gas-liquid stirring and mixing chamber 6 through the first jet hole 8*a* and stabilizes the flow around the outer side of the first jet hole 8*a* (jetting of a fluid mixture from the first jet hole 8*a* and inflow of outside gas or/and outside liquid).

Since the loop flow type gas-liquid stirring and mixing chamber 6 is a substantially cylindrical space, it is possible to easily form the high speed loop flow and easily obtain the above operation. Further, the asperities are formed on the inner wall of the loop flow type gas-liquid stirring and mixing chamber 6. Thus, collision of a fluid mixture of liquid and gas in a high speed loop flow with the asperities makes it possible to further break up gas inside the loop flow type gas-liquid stirring and mixing chamber 6 and accelerate the high speed loop flow to increase the degree of vacuum inside the loop flow type gas-liquid stirring and mixing chamber 6.

In the loop flow type bubble generation nozzle 10 having the above configuration, fine bubbles such as microbubbles each having a diameter equal to or less than a conventional diameter (approximately 20 μm) can be generated by the above operation.

Although, in the above operation of the loop flow type bubble generation nozzle 10, there has been described a case in which pressurized liquid is fed to the loop flow type gas-liquid stirring and mixing chamber 6 through the first liquid feed hole 5*a* and the second liquid feed hole 5*b* in this order, the present invention is not limited thereto. Fine bubbles such as microbubbles can be generated also by feeding sludge water or sea water containing impurities or tap water.

Modification of First Embodiment

Figure 3:
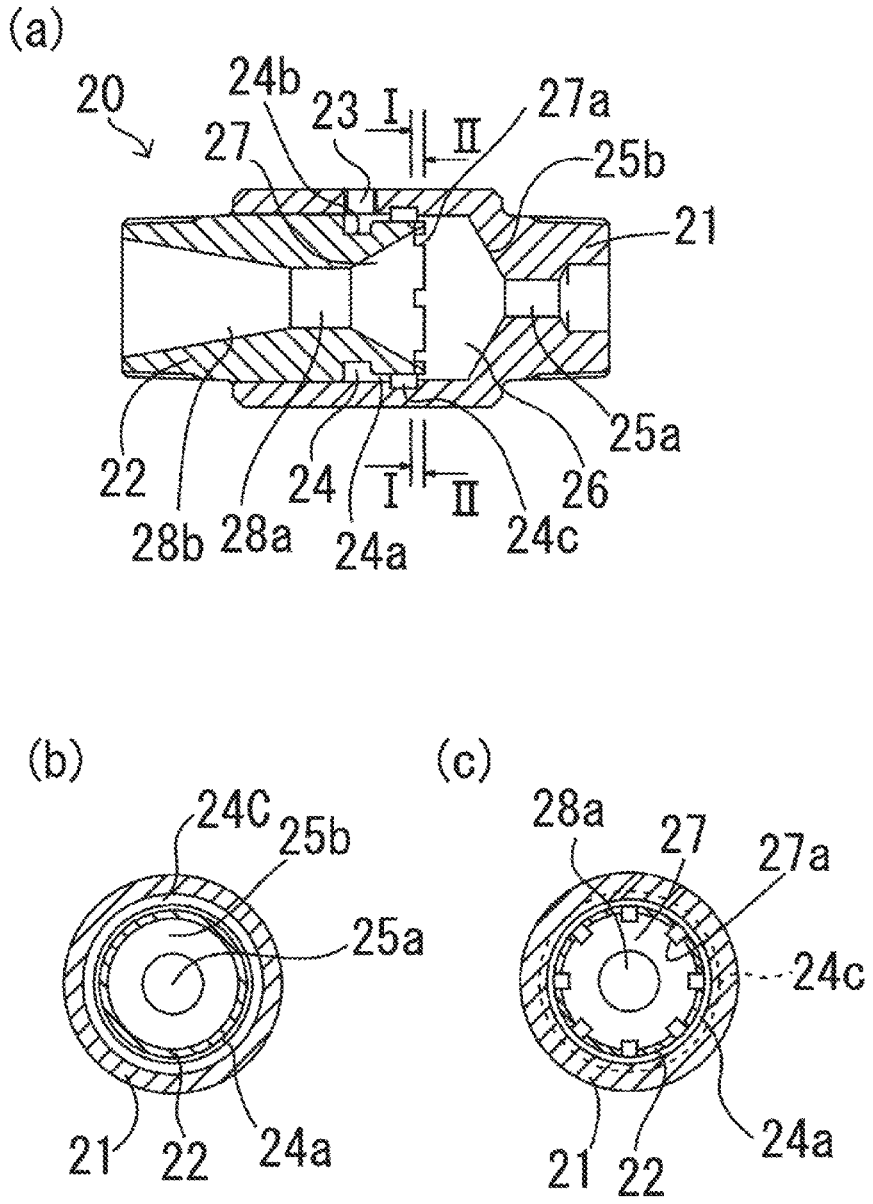
FIG. 3(*a*) is a schematic sectional view showing a loop flow type bubble generation nozzle according to a modification of the first embodiment, FIG. 3(*b*) is a sectional view on arrows I-I in FIG. 3(*a*), and FIG. 3(*c*) is a sectional view on arrows II-II in FIG. 3(*a*).

Next, a loop flow type bubble generation nozzle according to a modification of the first embodiment of the present invention will be described. FIGS. 3(*a*) to 3(*c*) are schematic sectional views showing a loop flow type bubble generation nozzle 20 according to the modification of the first embodiment.

Configuration of Loop Flow Type Bubble Generation Nozzle 20

As shown in FIG. 3(*a*), the loop flow type bubble generation nozzle 20 includes a bottomed member 21 as a bottomed tubular first member having a circular cross section and a tubular member 22 as a second member which is fitted into the other end side of the bottomed member 21. A substantially cylindrical space surrounded by the bottomed member 21 and the tubular member 22 serves as a loop flow type gas-liquid stirring and mixing chamber 26.

The tubular member 22 has a groove 24*b* which is located on an outer peripheral position facing a gas inflow hole 23 and continuous in the circumferential direction. A ring-like space surrounded by the groove 24*b* and the inner surface of the tubular member 22 serves as a gas feed chamber 24. The gas feed chamber 24 communicates with the loop flow type gas-liquid stirring and mixing chamber 26 through a clearance 24*a*. A recessed gas reservoir section 24*c* is formed on the clearance 24*a* at a side facing the loop flow type gas-liquid stirring and mixing chamber 26 along the entire circumference of the clearance 24*a*.

As shown in FIG. 3(*a*), the gas inflow hole 23 and the gas feed chamber 24 communicate with each other through the clearance 24*a*. Gas flowing in through the gas inflow hole 23 passes through the clearance 24*a* through the entire circumference or part of the circumference while being circulated around the central axis of a first liquid feed hole 25*a* in the gas feed chamber 24 to be fed to the loop flow type gas-liquid stirring and mixing chamber 26 toward one end side of the loop flow type gas-liquid stirring and mixing chamber 26. Accordingly, a film of gas, air bubbles or/and microbubbles are generated on the inner wall of the loop flow type gas-liquid stirring and mixing chamber 26, and a high speed loop flow is accelerated. Further, the amount of gas flowing in through the gas inflow hole 23 can be further increased by the gas reservoir section 24*c* near the gas feed chamber 24 to accelerate the generation of air bubbles. Further, (a) splash liquid which may get into the clearance 24*a* by a splash phenomenon caused by cavitation occurring in a gas-liquid boundary which is the boundary between the gas feed chamber 24 and the loop flow type gas-liquid stirring and mixing chamber 26 or/and (b) fine bubbles near the gas-liquid boundary may be dried, concentrated, or aggregated near the gas-liquid boundary to cause scale or/and sludge of, for example, calcium to deposit and adhere in a ring-like form onto the outer surface of the tubular member 22 or/and the inner surface of the bottomed member 21 inside the clearance 24*a*. Even in such a case, since a sufficient space is ensured by the gas reservoir section 24*c*, the clearance 24*a* (the gas feed chamber 24) is not blocked. As a result, in the loop flow type bubble generation nozzle 20 according to the present modification, the bubble generation efficiency is not reduced even when liquid containing impurities is used. Accordingly, since gas flowing in through the gas inflow hole 23 is stably fed to the loop flow type gas-liquid stirring and mixing chamber 26, the high speed loop flow inside the loop flow type gas-liquid stirring and mixing chamber 26 can be stabilized.

The other configuration and operation are the same as those in the first embodiment. Thus, description thereof will be omitted.

Outline of Present Embodiment

As described above, the loop flow type bubble generation nozzle 10, 20 of the present embodiment includes the loop flow type gas-liquid stirring and mixing chamber 6, 26 which stirs and mixes liquid and gas by a loop-like flow to form a fluid mixture, the first liquid feed hole 5*a*, 25*a* and the second liquid feed hole 5*b*, 25*b* which are formed on one end of the loop flow type gas-liquid stirring and mixing chamber 6, 26 and feed pressurized liquid to the loop flow type gas-liquid stirring and mixing chamber 6, 26, the at least one gas inflow hole 3, 23 into which gas flows, the gas feed chamber 4, 24 which is formed on the other end side of the loop flow type gas-liquid stirring and mixing chamber 6, 26 and feeds gas flowing in through the gas inflow hole 3, 23 to the loop flow type gas-liquid stirring and mixing chamber 6, 26 toward one end side of the loop flow type gas-liquid stirring and mixing chamber 6, 26 through the entire circumference or part of the circumference while circulating the gas around the central axis of the first liquid feed hole 5*a*, 25*a*, the inflow hole 7, 27 which is formed on the other end of the loop flow type gas-liquid stirring and mixing chamber 6, 26 in a manner to align the central axis thereof with the central axis of the first liquid feed hole 5*a*, 25*a* and has the plurality of cut-away parts 7*a*, 27*a*, and the first jet hole 8*a*, 28*a* and the second jet hole 8*b*, 28*b* which jet the fluid mixture from the loop flow type gas-liquid stirring and mixing chamber 6, 26.

In the above configuration, liquid is fed to the loop flow type gas-liquid stirring and mixing chamber 6, 26 through the first liquid feed hole 5*a*, 25*a* and the second liquid feed hole 5*b*, 25*b* and gas is fed to the loop flow type gas-liquid stirring and mixing chamber 6, 26 through the gas feed chamber 4, 24. Accordingly, when the fluid mixture inside the loop flow type gas-liquid stirring and mixing chamber 6, 26 is jetted through the second jet hole 8*b*, 28*b*, a loop-like flow (also referred to as "loop flow") of liquid containing gas is generated inside the loop flow type gas-liquid stirring and mixing chamber 6, 26.

When the fluid mixture inside the loop flow type gas-liquid stirring and mixing chamber 6, 26 is jetted through the second jet hole 8*b*, 28*b*, the inside of the loop flow type gas-liquid stirring and mixing chamber 6, 26 is brought into a negative pressure. Thus, gas flows in from the gas inflow hole 3, 23 through the gas feed chamber 4, 24. In addition, since the diameter of the first jet hole 8*a*, 28*a* is larger than the diameter of the first liquid feed hole 5*a*, 25*a*, outside gas or/and outside liquid flows into the loop flow type gas-liquid stirring and mixing chamber 6, 26 through a gap between the inner wall of the first jet hole 8*a*, 28*a* and the periphery of the fluid mixture in the first jet hole 8*a*, 28*a*.

Gas fed into the loop flow type gas-liquid stirring and mixing chamber 6, 26 through the gas feed chamber 4, 24 is (a) broken up by a turbulent flow generated on the boundary between the gas feed chamber 4, 24 and the loop flow type gas-liquid stirring and mixing chamber 6, 26; (b) stirred and sheared by a high speed loop flow accelerated by the inflow hole 7, 27 and the second liquid feed hole 5*b*, 25*b*; (c) collides with the asperities on the inner wall of the loop flow type gas-liquid stirring and mixing chamber 6, 26; (d) further broken up by a turbulent flow generated when part of the gas collides with pressurized liquid fed through the first liquid feed hole 5*a*, 25*a* on the way; and (e) collides with outside gas and/or outside liquid flowing into the first jet hole 8*a*, 28*a* to be further broken up, and jetted as a fluid mixture containing bubbles or/and microbubbles through the second jet hole 8*b*, 28*b*. A mechanism of the generation of air bubbles micronized in these steps (a) to (e) is a feature of the loop flow type bubble generation nozzle 10, 20 and a superior point which is not provided in other nozzles.

Further, (f) gas flowing in through the gas inflow hole 3, 23 is fed into the loop flow type gas-liquid stirring and mixing chamber 6, 26 toward one end side of the loop flow type gas-liquid stirring and mixing chamber 6, 26 through the entire circumference or part of the circumference while being circulated around the central axis of the first liquid feed hole 5*a*, 25*a* in the gas feed chamber 4, 24. This step (f) improves the degree of vacuum inside the loop flow type gas-liquid stirring and mixing chamber 6, 26. Thus, it is possible to further increase the amount of gas flowing in through the gas inflow hole 3, 23 to accelerate the generation of air bubbles.

Thus, bubbles having an average diameter of less than 100 μm, in particular, microbubbles having an average diameter equal to or less than a conventional diameter, specifically, an average diameter of approximately 20 μm can be generated. Further, since gas in the high speed loop flow is stirred and sheared so as to be further broken up by the cut-away parts 7*a*, 27*a* of the inflow hole 7, 27. Thus, it is possible to improve the efficiency of generating bubbles or/and microbubbles compared to conventional nozzles in the gas-liquid boundary which is the boundary between the gas feed chamber 4, 24 and the loop flow type gas-liquid stirring and mixing chamber 6, 26. Further, splash liquid may be generated by a splash phenomenon caused by cavitation occurring in the gas-liquid boundary which is the boundary between the gas feed chamber 4, 24 and the loop flow type gas-liquid stirring and mixing chamber 6, 26. The splash liquid may get into the clearance 4*a*, 24*a* and may be dried therein. The dried splash liquid may be deposited and adhered in a ring-like form as scale or/and sludge of, for example, calcium onto the outer surface of the tubular member 2, 22 or/and the inner surface of the bottomed member 1, 21 inside the clearance 4*a*, 24*a*. However, since a part in which scale or/and sludge is not deposited is provided by the cut-away part 7*a*, 27*a* or a sufficient space is ensured by the gas reservoir section 24*c*, the clearance 4*a*, 24*a* is not blocked. As a result, in the loop flow type bubble generation nozzle 10, 20 according to the present embodiment, the bubble generation efficiency is not reduced even when liquid containing impurities is used. Further, since gas flowing in through the gas inflow hole 3, 23 is stably fed to the loop flow type gas-liquid stirring and mixing chamber 6, 26, the high speed loop flow inside the loop flow type gas-liquid stirring and mixing chamber 6, 26 can be stabilized.

Further, since the inflow hole 7, 27 formed in a tapered shape accelerates the high speed loop flow and the second liquid feed hole 5*b*, 25*b* generates a violent turbulent flow, gas inside the loop flow type gas-liquid stirring and mixing chamber 6, 26 can be further broken up.

Further, the second jet hole 8*b*, 28*b* formed in a tapered shape adjusts the amount of outside gas and/or outside liquid flowing into the loop flow type gas-liquid stirring and mixing chamber 6, 26 through the first jet hole 8*a*, 28*a* and stabilizes the flow around the outer side of the first jet hole 8*a*, 28*a* (jetting of a fluid mixture from the first jet hole 8*a*, 28*a* and inflow of outside gas or/and outside liquid).

Further, the asperities are formed on the inner wall of the loop flow type gas-liquid stirring and mixing chamber 6, 26. Thus, collision of a fluid mixture of liquid and gas in a high speed loop flow with the asperities makes it possible to further break up gas inside the loop flow type gas-liquid stirring and mixing chamber 6, 26 and accelerate the high speed loop flow to increase the degree of vacuum inside the loop flow type gas-liquid stirring and mixing chamber 6, 26.

Second Embodiment

Figure 4:
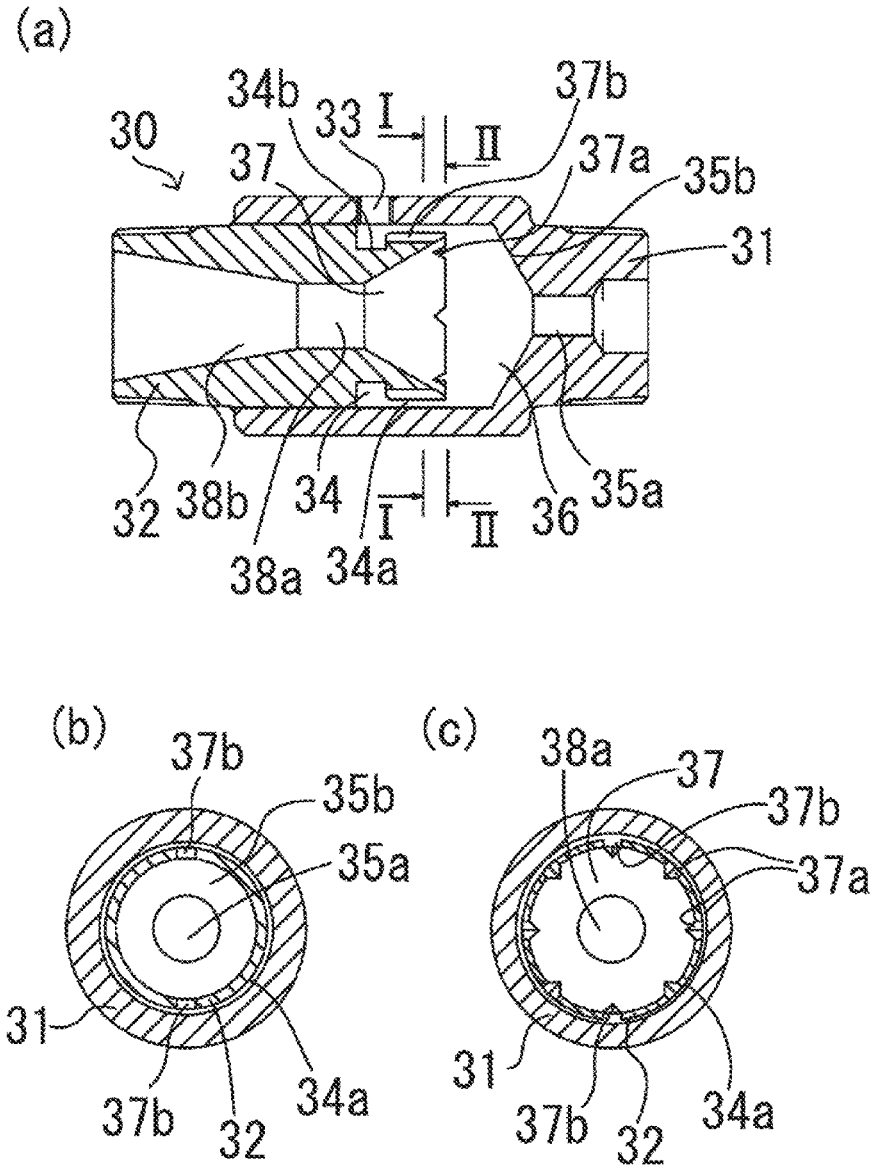
FIG. 4(*a*) is a schematic sectional view showing a bubble generation nozzle according to a second embodiment, FIG. 4(*b*) is a sectional view on arrows I-I in FIG. 4(*a*), and FIG. 4(*c*) is a sectional view on arrows II-II in FIG. 4(*a*).

A second embodiment of the present invention will be described below with reference to FIGS. 4(*a*) to 4(*c*). FIGS. 4(*a*) to 4(*c*) are schematic sectional views showing a loop flow type bubble generation nozzle 30 according to the second embodiment.

Configuration of Loop Flow Type Bubble Generation Nozzle 30

As shown in FIG. 4(*a*), the loop flow type bubble generation nozzle 30 includes a bottomed member 31 as a bottomed tubular first member having a circular cross section and a tubular member 32 as a second member which is fitted into the other end side of the bottomed member 31. A substantially cylindrical space surrounded by the bottomed member 31 and the tubular member 32 serves as a loop flow type gas-liquid stirring and mixing chamber 36.

The tubular member 32 has, on the center thereof, an inflow hole 37 which is capable of allowing liquid and gas to flow therein, and a first jet hole 38*a* and a second jet hole 38*b* which are capable of jetting liquid and gas. The inflow hole 37 is formed in a tapered shape whose diameter continuously expands from the first jet hole 38*a* toward the loop flow type gas-liquid stirring and mixing chamber 36. A plurality of cut-away parts 37*a* are formed on an end face of the inflow hole 37, the end face facing the loop flow type gas-liquid stirring and mixing chamber 36. A plurality of cut-away parts 37*b* are appropriately formed to extend from some of the cut-away parts 37*a* toward a gas feed chamber 34. The inflow hole 37 plays a role of accelerating a high speed loop flow inside the loop flow type gas-liquid stirring and mixing chamber 36. The cut-away parts 37*a* and 37*b* of the inflow hole 37 play a role of stirring and shearing gas in the high speed loop flow so as to be further broken up. Further, splash liquid which may get into a clearance 34*a* by a splash phenomenon caused by cavitation occurring in a gas-liquid boundary which is the boundary between the gas feed chamber 34 and the loop flow type gas-liquid stirring and mixing chamber 36 may be dried, concentrated, or aggregated to cause scale or/and sludge of, for example, calcium to deposit and adhere in a ring-like form onto the outer surface of the tubular member 32 or/and the inner surface of the bottomed member 31 inside the clearance 34*a*. Even in such a case, since the cut-away parts 37*a* and 37*b* remain as spaces (calcium or the like is not deposited and adhered onto the space part of each of the cut-away parts 37*a* and 37*b*), the clearance 34*a* is not blocked. As a result, in the loop flow type bubble generation nozzle 30 according to the present embodiment, the bubble generation efficiency is not reduced even when liquid containing impurities is used. Accordingly, since gas flowing in through the gas inflow hole 33 is stably fed to the loop flow type gas-liquid stirring and mixing chamber 36, the high speed loop flow inside the loop flow type gas-liquid stirring and mixing chamber 36 can be stabilized.

The other configuration and operation are the same as those in the first embodiment. Thus, description thereof will be omitted.

Modification 1 of Second Embodiment

Figure 5:
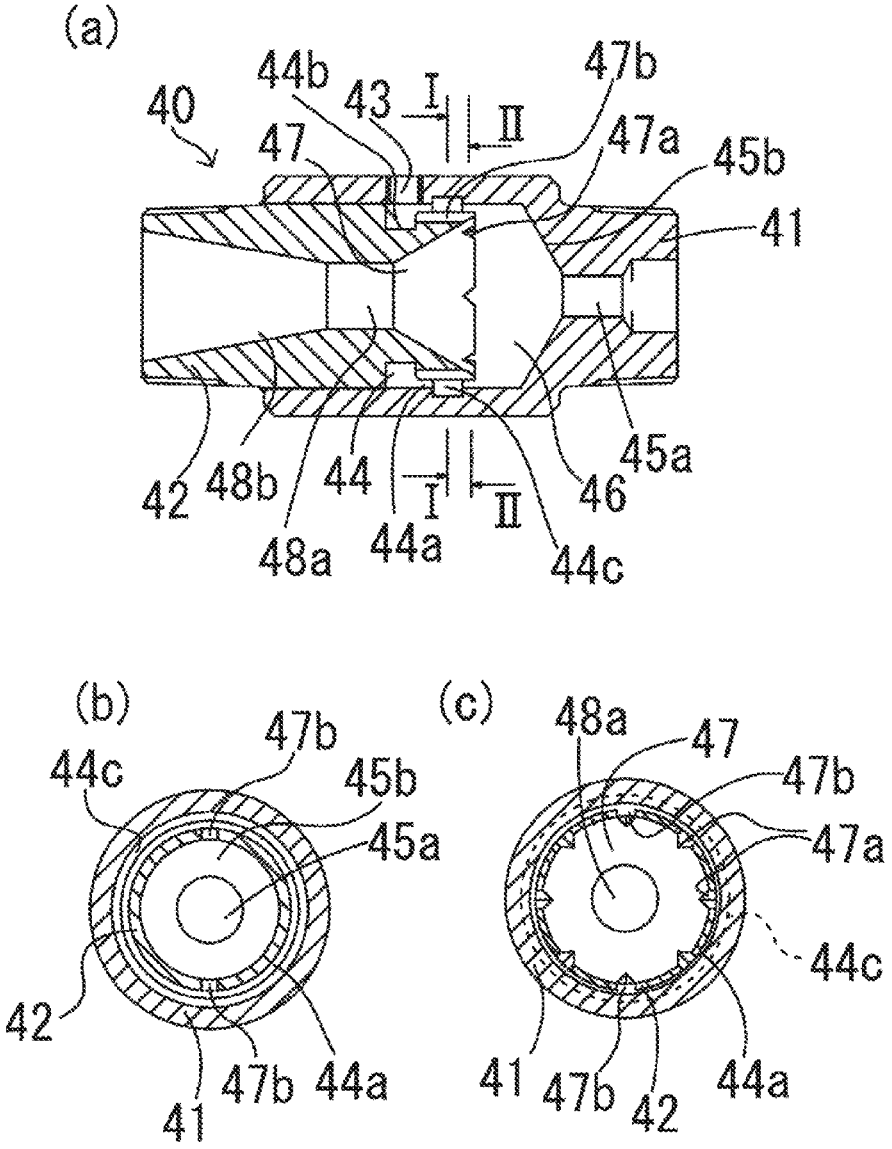
FIG. 5(*a*) is a schematic sectional view showing a loop flow type bubble generation nozzle according to Modification 1 of the second embodiment, FIG. 5(*b*) is a sectional view on arrows I-I in FIG. 5(*a*), and FIG. 5(*c*) is a sectional view on arrows II-II in FIG. 5(*a*).

Next, a loop flow type bubble generation nozzle according to Modification 1 of the second embodiment of the present invention will be described. FIGS. 5(*a*) to 5(*c*) are schematic sectional views showing a loop flow type bubble generation nozzle 40 according to Modification 1 of the second embodiment.

Configuration of Loop Flow Type Bubble Generation Nozzle 40

As shown in FIG. 5(*a*), the loop flow type bubble generation nozzle 40 includes a bottomed member 41 as a bottomed tubular first member having a circular cross section and a tubular member 42 as a second member which is fitted into the other end side of the bottomed member 41. A substantially cylindrical space surrounded by the bottomed member 41 and the tubular member 42 serves as a loop flow type gas-liquid stirring and mixing chamber 46.

The tubular member 42 has a groove 44*b* which is located on an outer peripheral position facing a gas inflow hole 43 and continuous in the circumferential direction. A ring-like space surrounded by the groove 44*b* and the inner surface of the tubular member 42 serves as a gas feed chamber 44. The gas feed chamber 44 communicates with the loop flow type gas-liquid stirring and mixing chamber 46 through a clearance 44*a*. A gas reservoir section 44*c* is formed near the gas feed chamber 44.

As shown in FIG. 5(*a*), the gas inflow hole 43 and the gas feed chamber 44 communicate with each other through the clearance 44*a*. Gas flowing in through the gas inflow hole 43 passes through the clearance 44*a* through the entire circumference or part of the circumference while being circulated around the central axis of a first liquid feed hole 45*a* in the gas feed chamber 44 to be fed to the loop flow type gas-liquid stirring and mixing chamber 46 toward one end side of the loop flow type gas-liquid stirring and mixing chamber 46. Accordingly, a film of gas, air bubbles or/and microbubbles are generated on the inner wall of the loop flow type gas-liquid stirring and mixing chamber 46, and a high speed loop flow is accelerated. Further, the amount of gas flowing in through the gas inflow hole 43 can be further increased by the gas reservoir section 44*c* near the gas feed chamber 44 to accelerate the generation of air bubbles. Further, splash liquid which may get into the clearance 44*a* by a splash phenomenon caused by cavitation occurring in a gas-liquid boundary which is the boundary between the gas feed chamber 44 and the loop flow type gas-liquid stirring and mixing chamber 46 may be dried, concentrated, or aggregated to cause scale or/and sludge of, for example, calcium to deposit and adhere in a ring-like form onto the outer surface of the tubular member 42 or/and the inner surface of the bottomed member 41 inside the clearance 44*a*. Even in such a case, since a sufficient space is ensured by the gas reservoir section 24*c*, the clearance 44*a* is not blocked. As a result, in the loop flow type bubble generation nozzle 40 according to the present modification, the bubble generation efficiency is not reduced even when liquid containing impurities is used. Accordingly, since gas flowing in through the gas inflow hole 43 is stably fed to the loop flow type gas-liquid stirring and mixing chamber 46, the high speed loop flow inside the loop flow type gas-liquid stirring and mixing chamber 46 can be stabilized.

The other configuration and operation are the same as those in the first embodiment. Thus, description thereof will be omitted.

Modification 2 of Second Embodiment

Figure 6:
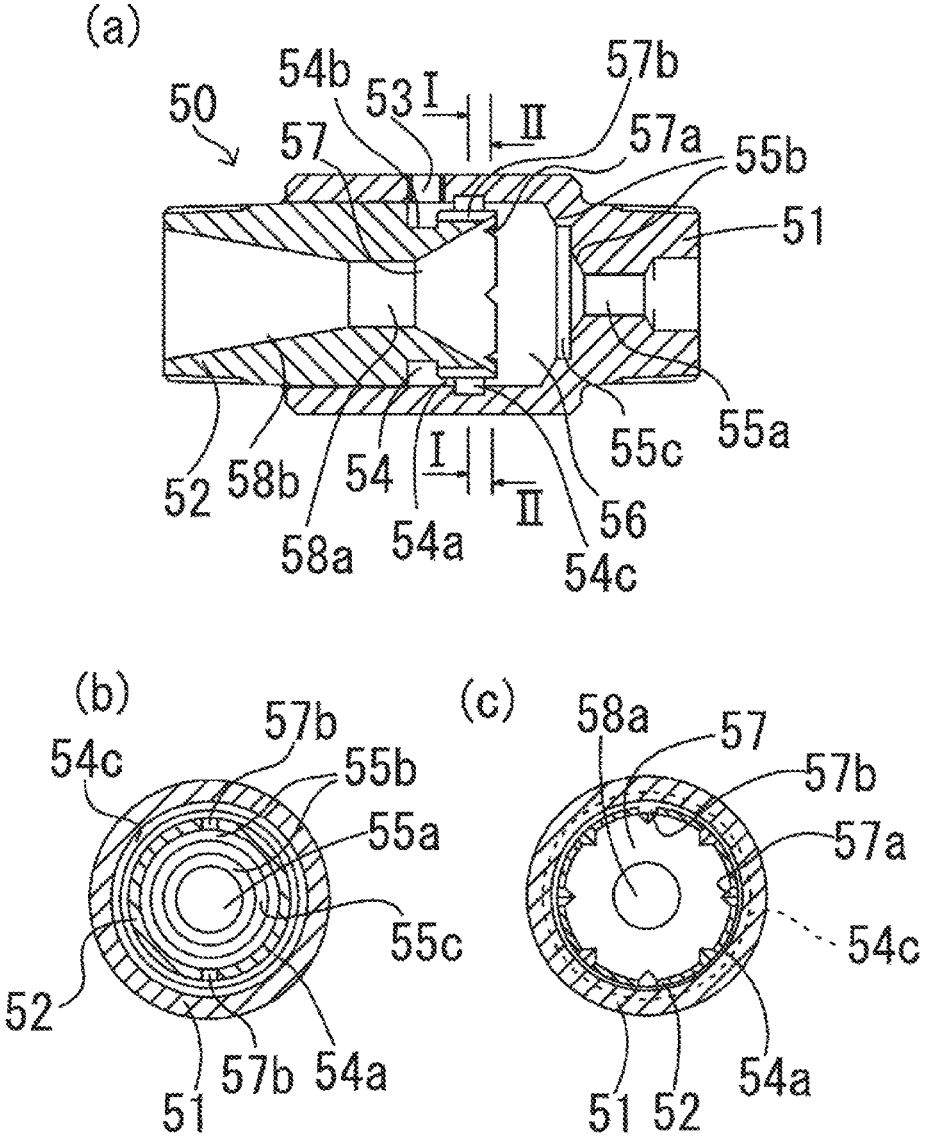
FIG. 6(*a*) is a schematic sectional view showing a bubble generation nozzle according to Modification 2 of the second embodiment, FIG. 6(*b*) is a sectional view on arrows I-I in FIG. 6(*a*), and FIG. 6(*c*) is a sectional view on arrows II-II in FIG. 6(*a*).

Next, a loop flow type bubble generation nozzle according to Modification 2 of the second embodiment of the present invention will be described. FIGS. 6(*a*) to 6(*c*) are schematic sectional views showing a loop flow type bubble generation nozzle 40 according to Modification 2 of the second embodiment.

Configuration of Loop Flow Type Bubble Generation Nozzle 50

As shown in FIG. 6(*a*), the loop flow type bubble generation nozzle 50 has a configuration substantially similar to the configuration of the loop flow type bubble generation nozzle 40 according to Modification 2 of the second embodiment of the present invention. The loop flow type bubble generation nozzle 50 differs from the loop flow type bubble generation nozzle 40 in that a stirring and mixing section 55*c* which further stirs and mixes a fluid mixture inside a loop flow type gas-liquid stirring and mixing chamber 56 is provided.

The stirring and mixing section 55*c* is a ring-like recessed groove which is formed on the midway part of a second liquid feed hole 55*b* in a manner to substantially align the central axis thereof with the central axis of the second liquid feed hole 55*b*. A loop flow which is smaller than a loop flow generated inside the loop flow type gas-liquid stirring and mixing chamber 56 is generated in the stirring and mixing section 55*c*. The loop flow generated in the stirring and mixing section 55*c* further stirs and mixes a fluid mixture inside the loop flow type gas-liquid stirring and mixing chamber 56 to efficiently generate air bubbles.

The other configuration and operation are the same as those in the first embodiment and Modification 1 of the second embodiment. Thus, description thereof will be omitted.

Outline of Present Embodiment

As described above, the loop flow type bubble generation nozzle 30, 40, 50 of the present embodiment includes the loop flow type gas-liquid stirring and mixing chamber 36, 46, 56 which stirs and mixes liquid and gas by a loop-like flow to form a fluid mixture, the first liquid feed hole 35*a*, 45*a*, 55*a* and the second liquid feed hole 35*b*, 45*b*, 55*b* which are formed on one end of the loop flow type gas-liquid stirring and mixing chamber 36, 46, 56 and feed pressurized liquid to the loop flow type gas-liquid stirring and mixing chamber 36, 46, 56, the at least one gas inflow hole 33, 43, 53 into which gas flows, the gas feed chamber 34, 44, 54 which is formed on the other end side of the loop flow type gas-liquid stirring and mixing chamber 36, 46, 56 and feeds gas flowing in through the gas inflow hole 33, 43, 53 to the loop flow type gas-liquid stirring and mixing chamber 36, 46, 56 toward one end side of the loop flow type gas-liquid stirring and mixing chamber 36, 46, 56 through the entire circumference or part of the circumference while circulating the gas around the central axis of the first liquid feed hole 35*a*, 45*a*, 55*a*, the inflow hole 37, 47, 57 which is formed on the other end of the loop flow type gas-liquid stirring and mixing chamber 36, 46, 56 in a manner to align the central axis thereof with the central axis of the first liquid feed hole 35*a*, 45*a*, 55*a* and has the plurality of cut-away parts 37*a*, 47*a*, 57*a* and 37*b*, 47*b*, 57*b*, and the first jet hole 38*a*, 48*a*, 58*a* and the second jet hole 38*b*, 48*b*, 58*b* which jet the fluid mixture from the loop flow type gas-liquid stirring and mixing chamber 36, 46, 56.

In the above configuration, liquid is fed to the loop flow type gas-liquid stirring and mixing chamber 36, 46, 56 through the first liquid feed hole 35*a*, 45*a*, 55*a* and the second liquid feed hole 35*b*, 45*b*, 55*b* and gas is fed to the loop flow type gas-liquid stirring and mixing chamber 36, 46, 56 through the gas feed chamber 34, 44, 54. Accordingly, when the fluid mixture inside the loop flow type gas-liquid stirring and mixing chamber 36, 46, 56 is jetted through the second jet hole 38*b*, 48*b*, 58*b*, a loop-like flow (also referred to as "loop flow") of liquid containing gas is generated inside the loop flow type gas-liquid stirring and mixing chamber 36, 46, 56. Further, an effect similar to the effect of the first embodiment can be obtained.

Modifications of Each Embodiment

The embodiments of the present invention have been described above merely as concrete examples and thus do not limit the present invention. Therefore, the concrete configuration can be appropriately modified. The action and effect in the embodiments of the invention are described merely as the most preferable action and effect arising from the present invention. Thus, the action and effect obtained by the present invention is not limited to the action and the effect described in the embodiments of the present invention.

For example, in each of the embodiments and each of the modifications, the loop flow type bubble generation nozzle may be formed of a member whose surface is coated with resin or formed of only resin. Accordingly, since the member surface is coated with resin or the loop flow type bubble generation nozzle itself is formed of resin, corrosion can be prevented even in adverse environments such as sludge water and sea water. As a result, it is possible to provide a loop flow type bubble generation nozzle with long life and low cost.

In each of the embodiments and each of the modifications, the loop flow type bubble generation nozzle has the gas inflow hole. However, the loop flow type bubble generation nozzle may have no gas inflow hole when gas is dissolved in liquid fed from the liquid feed hole. In this case, the gas dissolved in the liquid is turned into bubbles in the loop flow type gas-liquid stirring and mixing chamber.

In the loop flow type bubble generation nozzle of each of the embodiments, the bottomed member having the gas inflow hole may further have an outside communication hole which is open on the peripheral surface of the loop flow type gas-liquid stirring and mixing chamber in a direction parallel to a tangent line of the peripheral surface of the loop flow type gas-liquid stirring and mixing chamber to communicate with the outside. In this configuration, outside liquid and/or outside gas flows into the loop flow type gas-liquid stirring and mixing chamber through the outside communication hole. Thus, it is possible to generate a swirl flow which flows along the peripheral surface of the loop flow type gas-liquid stirring and mixing chamber in addition to a loop flow to thereby tilt a flowing direction of the loop flow with respect to a feeding direction of liquid fed through the liquid feed hole. As a result, the distance of one round of the loop flow can be extended, and gas is thus sheared more often by a turbulent flow generated by the loop flow. Therefore, gas inside the loop flow type gas-liquid stirring and mixing chamber can be further broken up.

The shape of the loop flow type gas-liquid stirring and mixing chamber or the shape of the cut-away parts of the inflow hole is not limited to the shape described in each of the embodiments and each of the modifications. The shape of the loop flow type gas-liquid stirring and mixing chamber may be a substantially square tubular shape, a substantially triangular pyramid, a shape whose cross section has a polygonal shape such as a pentagon or a hexagon, or a shape whose cross section has a complicated shape such as a star shape (including an irregular shape).

In each of the embodiments and each of the modifications, the gas inflow hole may be formed close to the jet holes.

In each of the embodiments and each of the modifications, the gas reservoir section may be formed on the surface of the tubular member. Although, in each of the embodiments and each of the modifications, the gas reservoir section is formed in a recessed shape (ring-like shape) along the entire circumference of the clearance, the present invention is not limited thereto. A recess may be formed only in part of the outer surface of the tubular member or/and the inner surface of the bottomed member inside the clearance in which scale or/and sludge are likely to be deposited in a conventional configuration to prevent obstruction of gas feed.

In each of the embodiments and each of the modifications, one similar to the stirring and mixing section 55*c* provided in the loop flow type bubble generation nozzle 50 of Modification 2 of the second embodiment may be provided in any part of the loop flow type gas-liquid stirring and mixing chamber. Although the stirring and mixing section 55*c* has a recessed ring-like shape, the present invention is not limited thereto. One or more simple recesses (for example, depressions) or a groove (recess) formed in a helical shape may be formed as the stirring and mixing section 55*c* as long as the fluid mixture inside the loop flow type gas-liquid stirring and mixing chamber can be further stirred and mixed.

The bubble generation nozzle/loop flow type bubble generation nozzle of the present invention may be manufactured to have a large size or a small size. The bubble generation nozzle/loop flow type bubble generation nozzle of the present invention is applicable to all purposes that can use microbubbles. Specifically, the large bubble generation nozzle/loop flow type bubble generation nozzle is applicable, for example, to industrial fields, sewage treatment in, for example, sewerage, purification of rivers and sea water, removal of water bloom, revival, breeding and culture of fishes and shellfishes, and raising of rice and weeding in paddy fields. On the other hand, the small bubble generation nozzle/loop flow type bubble generation nozzle is applicable, for example, to purification of water tanks and fish preserves, raising in hydroponic culture, microbubble bathes, washers, portable ultra-compact microbubble generators, and small water tanks when a temperature rise is not desired. Further, use in medical fields is also under consideration. Furthermore, the bubble generation nozzle/loop flow type bubble generation nozzle of the present invention can also be used in decolorization and sterilization.

REFERENCE SIGNS LIST

1, 21, 31, 41, 51: Bottomed member
2, 22, 32, 42, 52: Tubular member
3, 23, 33, 43, 53: Gas inflow hole
4, 24, 34, 44, 54: Gas feed chamber
4*a*, 24*a*, 34*a*, 44*a*, 54*a*: Clearance
4*b*, 24*b*, 34*b*, 44*b*, 54*b*: Groove
5*a*, 25*a*, 35*a*, 45*a*, 55*a*: First liquid feed hole
5*b*, 25*b*, 35*b*, 45*b*, 55*b*: Second liquid feed hole
6, 26, 36, 46, 56: Loop flow type gas-liquid stirring and mixing chamber
7, 27, 37, 47, 57: Inflow hole
7*a*, 27*a*, 37*a*, 37*b*, 47*a*, 57*a*, 57*b*: Cut-away part
8*a*, 28*a*, 38*a*, 48*a*, 58*a*: First jet hole
8*b*, 28*b*, 38*b*, 48*b*, 58*b*: Second jet hole
10, 20, 30, 40, 50: Loop flow type bubble generation nozzle
11: Hose
12: Shower head
13: Gas feed tube
13*a*: Check valve
14: Throttle valve
24*c*, 44*c*, 54*c*: Gas reservoir section
55*c*: Stirring and mixing section

The invention claimed is:

1. A loop flow type bubble generation nozzle comprising:

a loop flow type gas-liquid stirring and mixing chamber that stirs and mixes liquid and gas by a loop-like flow to form a fluid mixture;

a liquid feed hole formed on one end of the loop flow type gas-liquid stirring and mixing chamber, the liquid feed hole feeding pressurized liquid to the loop flow type gas-liquid stirring and mixing chamber;

at least one gas inflow hole into which gas flows;

a gas feed chamber formed on the other end side of the loop flow type gas-liquid stirring and mixing chamber, the gas feed chamber feeding gas flowing in through the at least one gas inflow hole to the loop flow type gas-liquid stirring and mixing chamber toward one end side of the loop flow type gas-liquid stirring and mixing chamber through the entire circumference or part of the circumference while circulating the gas around a central axis of the liquid feed hole;

a jet hole formed on the other end of the loop flow type gas-liquid stirring and mixing chamber in a manner to align a central axis of the jet hole with the central axis of the liquid feed hole, the jet hole having a diameter larger than the diameter of the liquid feed hole and jetting the fluid mixture from the loop flow type gas-liquid stirring and mixing chamber; and a tapered section whose diameter continuously expands from the jet hole toward the loop flow type gas-liquid stirring and mixing chamber, wherein at least one cut-away part is formed on an end of the tapered section, the end facing the loop flow type gas-liquid stirring and mixing chamber.

2. The loop flow type bubble generation nozzle according to claim 1, wherein a cut-away part is further formed to extend from the at least one cut-away part toward the gas feed chamber.

3. A loop flow type bubble generation nozzle comprising:

a loop flow type gas-liquid stirring and mixing chamber that stirs and mixes liquid and gas by a loop-like flow to form a fluid mixture;

a liquid feed hole formed on one end of the loop flow type gas-liquid stirring and mixing chamber, the liquid feed hole feeding pressurized liquid to the loop flow type gas-liquid stirring and mixing chamber;

at least one gas inflow hole into which gas flows;

a gas feed chamber formed on the other end side of the loop flow type gas-liquid stirring and mixing chamber, the gas feed chamber feeding gas flowing in through the at least one gas inflow hole to the loop flow type gas-liquid stirring and mixing chamber toward one end side of the loop flow type gas-liquid stirring and mixing chamber through the entire circumference or part of the circumference while circulating the gas around a central axis of the liquid feed hole;

a jet hole formed on the other end of the loop flow type gas-liquid stirring and mixing chamber in a manner to align a central axis of the jet hole with the central axis of the liquid feed hole, the jet hole having a diameter larger than the diameter of the liquid feed hole and jetting the fluid mixture from the loop flow type gas-liquid stirring and mixing chamber; and a recessed gas reservoir section formed on the gas feed chamber at a side facing the loop flow type gas-liquid stirring and mixing chamber on the entire circumference or part of the circumference of the gas feed chamber.

4. The loop flow type bubble generation nozzle according to claim 1, wherein a recessed stirring and mixing section that further stirs and mixes the fluid mixture inside the loop flow type gas-liquid stirring and mixing chamber is formed on an inner wall of the loop flow type gas-liquid stirring and mixing chamber.

* * * * *